United States Patent [19]

Blum et al.

[11] 4,032,287

[45] June 28, 1977

[54] COMBINATION BURNER

[75] Inventors: Kenneth J. Blum, Hudson, N.Y.; Floyd Dodson, Ross Township, Allegheny County, Pa.; Robert P. Jarrett, Livingston Township, Columbia County; Norman T. Ravnsborg, Claverack, both of N.Y.

[73] Assignee: United States Steel Corporation, Pittsburgh, Pa.

[22] Filed: June 16, 1975

[21] Appl. No.: 587,442

[52] U.S. Cl. ..... 431/175; 431/278; 110/22 A

[51] Int. Cl.[2] ..... F23C 5/28; F23C 1/10; F23C 1/12

[58] Field of Search ..... 110/22 R, 22 A, 72 R, 110/28 V; 431/174, 175, 278

[56] References Cited

UNITED STATES PATENTS

| | | | |
|---|---|---|---|
| 717,582 | 1/1903 | Kent | 110/22 R |
| 719,716 | 2/1903 | Anderson | 431/175 |
| 785,991 | 3/1905 | Welles | 110/22 A |
| 1,729,217 | 9/1929 | Hufschmidt | 431/175 |
| 3,100,461 | 8/1963 | Werner | 110/28 A |
| 3,115,851 | 12/1963 | Ceely | 431/174 |
| 3,934,522 | 1/1976 | Booker | 110/28 R |

*Primary Examiner*—William R. Cline
*Attorney, Agent, or Firm*—Rea C. Helm

[57] ABSTRACT

A combination burner has a burner pipe for pulverized fuel beside a burner chamber for fluid fuel. A plurality of retractable nozzles mounted in a retractable housing inside the chamber are connected to a plurality of fluid fuel sources. Primary air may be controlled in varying amounts to both burner pipe and burner chamber. Nozzles may be angled with respect to burner pipe to provide supportive flame.

6 Claims, 6 Drawing Figures

COMBINATION BURNER

This invention relates to burners for pyroprocessing equipment and more particularly to a cement kiln burner which may burn liquid, gaseous or solid pulverized fuels either singly or in combination.

Since the availability of fuels suitable for use in a cement manufacturing kiln varies from time to time, it is very advantageous to be able to readily change from one type fuel or combination of fuels to another type fuel or combination of fuels and to have the capability of burning a variety of combinations of fuels. Such flexibility provides the opportunities for optimal low-cost firing and optimal control of stack emissions commensurate with environmental standards.

Most combination burners require that the burner be turned off while the necessary equipment changes are made to switch from one fuel to another fuel. Shut down times of two hours are not uncommon. The changeovers are complicated by the fact that the large pipes required to conduct combustion supporting air result in bulky and unwieldy structures which are difficult to handle.

Some solid fuels that produce low deleterious stack emissions are incapable by themselves of sustaining combustion and therefore require a supportive flame. Existing dual burners that we are aware of do not have the capability of supplying a small quantity of a liquid or gaseous fuel as a support flame to a main flame produced by a pulverized solid fuel.

It is therefore an object of our invention to provide a burner system that will burn a solid pulverized fuel, a liquid fuel or a gaseous fuel or a combination of such fuels.

Another object is to provide a burner that has a supportive flame to maintain a stable ignition front of a flame produced by a fuel that does not sustain itself in combustion.

A further object is to provide a burner that may switch between pulverized solid, liquid or gaseous fuels without interruption of firing.

Still another object is to provide a burner that eliminates large piping required for the primary air when firing with liquid or gaseous fuels.

Figures 1, 2:
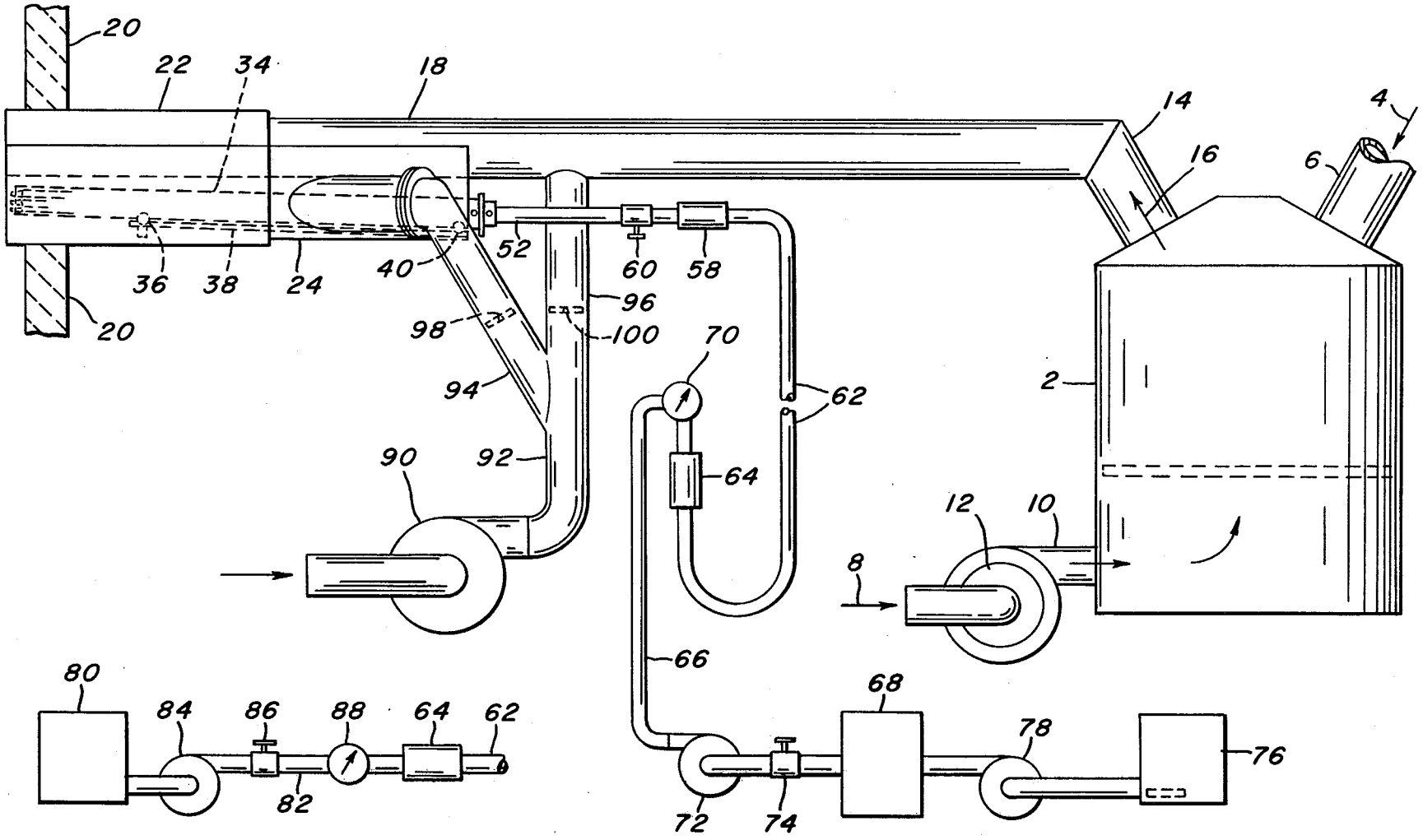
Figure 3:
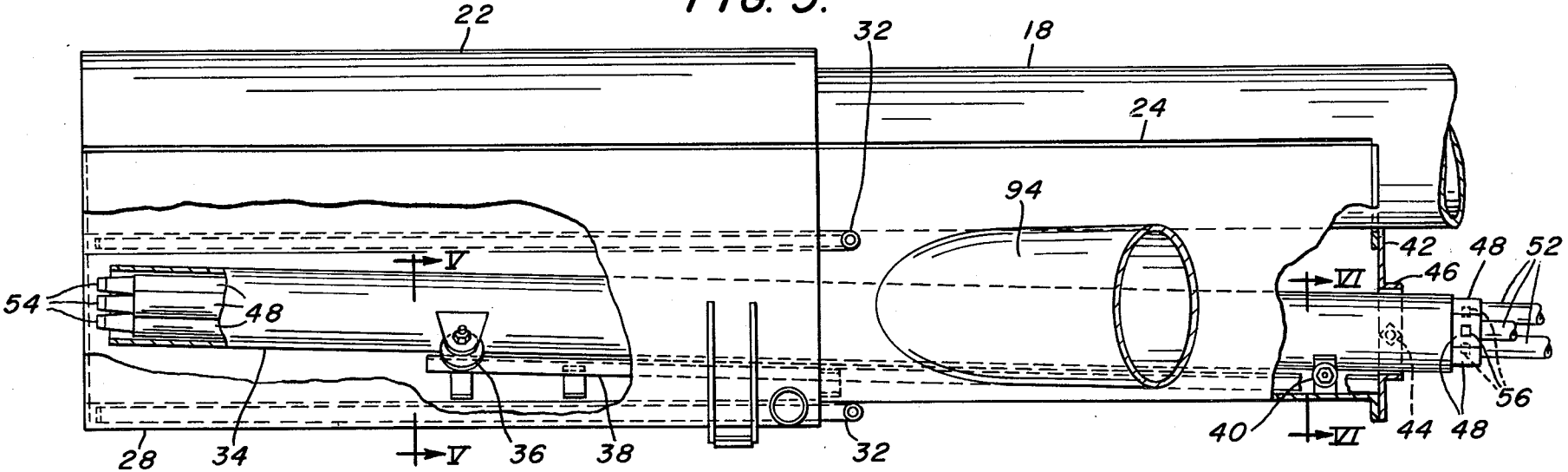
Figure 6:
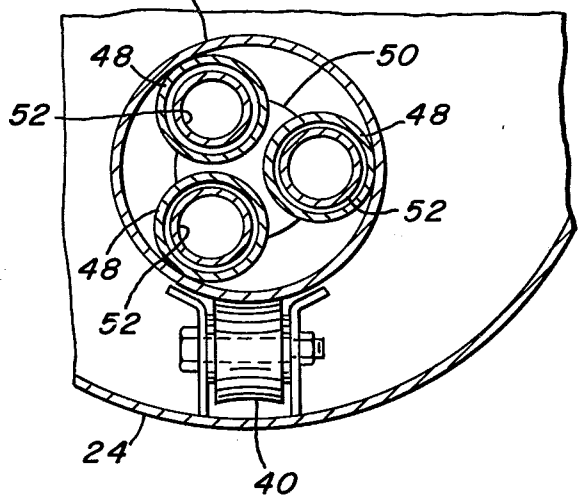
Figure 5:
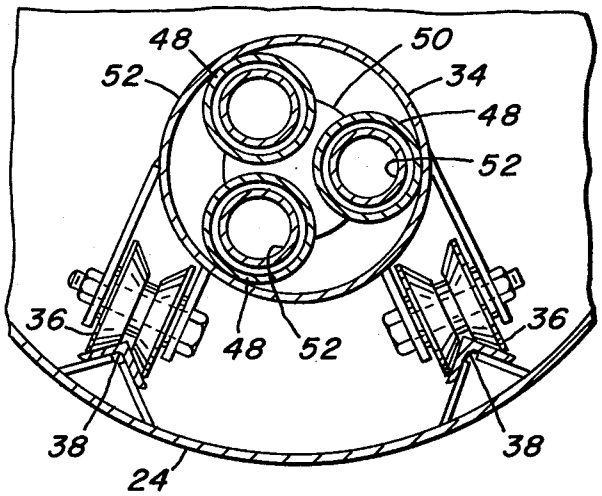
Figure 4:
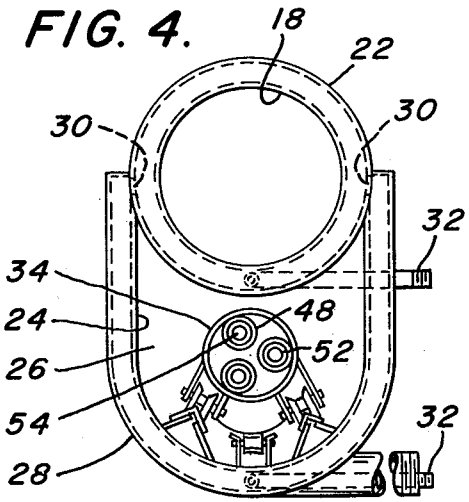

These and other objects will become more apparent after referring to the following specification and drawings in which:

FIG. 1 is a schematic drawing of the fuel system using the burner of our invention, FIG. 2 is a partial schematic drawing illustrating alternate fuel supply, FIG. 3 is an elevational view, partial cutaway to show interior feature, of the burner of our invention, FIG. 4 is an exit end view of the burner, FIG. 5 is a cross-sectional view along line V—V of FIG. 3 and FIG. 6 is a cross-sectional view along line VI—VI of FIG. 3.

Referring now to the drawings, reference numeral 2 represents a source of pulverized fuel such as a coal mill into which coal is fed in the direction of arrow 4 through a feed conduit 6 and primary air enters in the direction of arrow 8 through an air supply conduit 10 connected to a blast fan 12. An exit conduit 14 conducts the pulverized solid fuel carried in suspension by the high velocity primary air from fan 12 in the direction of arrow 16 to a burner pipe 18. A portion of the exit end of burner pipe 18, near its entrance through a kiln wall 20, as shown partially in FIG. 1, is surrounded by a cooling jacket 22. This is a conventional burner arrangement for firing a cement kiln with a pulverized solid fuel such as coal.

The combination burner of the invention has a U-shaped plate 24 mounted below the pulverized fuel burner and attached to it to define a burner chamber 26. A cooling jacket 28 surrounds part of plate 24 and is connected to cooling jacket 22 through openings 30 so that a coolant may flow between a coolant inlet and a coolant outlet connection 32 on jackets 22 and 28 to cool both jackets.

A burner housing tube 34 is mounted inside chamber 26 and is adapted for longitudinal movement inside chamber 26. Tube 34 is supported at its forward end by two guide rollers 36 operating on tracks 38 which are mounted on plate 24. A support roller 40 for housing 34 is mounted on plate 24 at the rear of chamber 26. An end plate 42 covers one end of chamber 26. Tube 34 projects through an opening in plate 42 and may be held in position with respect to chamber 26 by a set screw 44 mounted on a collar 46 attached to plate 42 and surrounding the opening in plate 42.

Three support tubes 48 are mounted inside housing tube 34. Tubes 48 extend from a location adjacent the exit end of the burner and extend slightly beyond the entrance end of tube 34 and are held in place inside tube 34 by a plurality of spacers 50, as shown in FIGS. 5 and 6. A burner tube 52 is mounted inside each support tube 48. Each tube 52 has a nozzle 54 of appropriate design for the type of fuel to be burned by the particular nozzle for the desired heating rate at one end and is held in place inside support tube 48 by a set screw 56. The other end of each tube 52 is connected to a fuel supply.

One such fuel supply may be a heavy oil for which a typical installation is shown in FIG. 1. Burner tube 52 ends in a fitting 58 and has a shut off valve 60. A long flexible tube 62 connects fitting 58 and a second fitting 64. Fitting 64 is connected by a conduit 66 to an oil heating boiler 68 through a meter 70, a pump 72 and a valve 74. Boiler 68 is fed from a heated storage tank 76 by another pump 78. For gaseous fuels, FIG. 2, a supply tank 80 is connected to fitting 64 by a conduit 82 through a pump 84, a valve 86 and a meter 88.

Burner chamber 26 is supplied with primary air from a primary air blower 90, through a conduit 92 to a lateral air inlet 94 and a branch conduit 96 that connects to burner pipe 18. A control valve 98 controls primary air flow through the lateral air inlet 94, a control valve 100 controls primary air flow through branch conduit 96.

When the combination burner is burning solid pulverized fuel, control valve 100 is closed and the burner operates in a conventional manner. As long as no fluid fuel is being used, set screw 44 is loosened and burner housing tube 34 is retracted a distance, for example 3 to 4 feet, to prevent the formation of deposits, as for example coke-like substances, on the unused nozzles 54 while firing the solid fuel. If, however, the solid fuel is the type that requires a supportive flame, one or more of the burner tubes 52 are put in use with a fluid fuel. This requires adjusting control valves 98 and 100 so that primary air for the fluid fuel passes through both burner pipe 18 and burner chamber 26. By passing some of the required primary air for the fluid fuel through burner tube 18, the size of the lateral air inlet 94 and the burner chamber 26 may be considerably reduced. Guide roller tracks 38 are sloped so that the flame from the lower fluid nozzle or nozzles will meet the flame from the upper pulverized fuel burner at a desired location inside the kiln away from the kiln wall 20. The location is selected to maintain burning of the solid fuel and to prevent puffing in the kiln. Housing tube 34 is moved forward so that the nozzles are in the firing position as shown in FIG. 3.

If any one or two of the three nozzles is not required, then the appropriate set screw of screws 56 may be loosened and the burner tube or tubes 52 retracted to prevent the formation of undesirable deposits.

In switching from one type fuel to another, it is only necessary to start burning the new fuel while gradually shutting off the fuel from the previously operated burner. This will require not only adjustment of fuel flow but also adjustment of control valves 98 and 100.

While the invention has been described as adapted to burn solid pulverized fuel, heated oil or a gaseous fuel, obviously a variety of combinations could be used in the burner. All three fluid burners could be connected by a manifold to a single source or there could be three separate sources of fuel. More or less than three fluid fuels may either be provided for or burned singly or in combination.

While several embodiments have been shown and described, it will be understood that other changes may be made without departing from the scope of the following claims.

We claim:

1. A burner for burning solid pulverized and fluid fuels singly or in combination comprising:

a burner pipe adapted for burning a pulverized fuel carried in suspension in its primary air, a burner chamber fixed with respect to the burner pipe mounted generally parallel to and adjacent the burner pipe, a burner housing tube mounted for longitudinal movement within the burner chamber, a fluid burner nozzle mounted inside the housing tube, means for clamping the burner housing tube in position with respect to the burner chamber, a source of fluid fuel, means connecting the source of fluid fuel to the nozzle, a source of primary air for the fluid fuel, an outlet conduit from the source of primary air for the fluid fuel, a first branch conduit connecting the outlet conduit to the burner pipe, a second branch conduit connecting the outlet conduit to the burner chamber, and control means in each branch conduit for controlling the flow of air from the source of air for the fluid fuel through each branch conduit.

2. A burner for burning solid pulverized and fluid fuels singly or in combination comprising:

a burner pipe adapted for burning a pulverized fuel carried in suspension in its primary air, a burner chamber fixed with respect to the burner pipe mounted generally parallel to and adjacent the burner pipe, a burner housing tube mounted for longitudinal movement within the burner chamber, a fluid burner nozzle mounted inside the housing tube with the longitudinal axis of the nozzle at an angle to the longitudinal axis of the burner pipe so that the flame from the nozzle supports combustion of the pulverized fuel, means for clamping the burner housing tube in position with respect to the burner chamber, a source of fluid fuel, means connecting the source of fluid fuel to the nozzle, a source of primary air for the fluid fuel, an outlet conduit from the source of primary air for the fluid fuel, a first branch conduit connecting the outlet conduit to the burner pipe, a second branch conduit connecting the outlet conduit to the burner chamber, and control means in each branch conduit for controlling the flow of air from the source of air for the fluid fuel through each branch conduit.

3. A burner for burning solid pulverized and fluid fuels singly or in combination comprising:

a burner pipe adapted for burning a pulverized fuel carried in suspension in its primary air, a burner chamber fixed with respect to the burner pipe mounted generally parallel to and adjacent the burner pipe, a burner housing tube mounted inside the burner chamber, a plurality of burner support tubes mounted in the burner housing tube, a plurality of burner tubes, one mounted inside each burner support tube, a plurality of fluid burner nozzles, one mounted on the end of each burner tube, a plurality of sources of fluid fuel, means connecting a source of fluid fuel to each nozzle, a source of primary air for the fluid fuels, an outlet conduit from the source of primary air for the fluid fuels, a first branch conduit connecting the outlet conduit to the burner pipe, a second branch conduit connecting the outlet conduit to the burner chamber, and control means in each branch conduit for controlling the flow of air from the source of air for the fluid fuels through each branch conduit.

4. A burner according to claim 3 in which the burner housing tube is movable longitudinally within the burner chamber and which includes means for clamping the burner housing tube in position with respect to the burner chamber.

5. A burner according to claim 6 in which the longitudinal axis of the burner pipe is at such an angle to the longitudinal axis of one of said nozzles that the axes intersect in a manner whereby the flame from said one nozzle supports combustion of the pulverized fuel.

6. A burner according to claim 4 in which each burner tube is movable longitudinally within its respective burner support tube and which includes means for clamping the burner tube in position with respect to the burner support tube.

* * * * *